US008258455B2

(12) United States Patent
Kakuyama et al.

(10) Patent No.: US 8,258,455 B2
(45) Date of Patent: Sep. 4, 2012

(54) AUTOMATIC DOOR SYSTEM WITH SENSOR USED THEREIN

(75) Inventors: Koji Kakuyama, Kobe (JP); Yoshinari Kiyomasa, Kobe (JP)

(73) Assignee: Nabtesco Corporation, Tokyo (JP)

( * ) Notice: Subject to any disclaimer, the term of this patent is extended or adjusted under 35 U.S.C. 154(b) by 384 days.

(21) Appl. No.: 12/446,726

(22) PCT Filed: Sep. 25, 2007

(86) PCT No.: PCT/JP2007/068525
§ 371 (c)(1),
(2), (4) Date: Apr. 22, 2009

(87) PCT Pub. No.: WO2008/050565

PCT Pub. Date: May 2, 2008

(65) Prior Publication Data

US 2010/0024302 A1 Feb. 4, 2010

(30) Foreign Application Priority Data

Oct. 24, 2006 (JP) ..... 2006-288817

(51) Int. Cl.
*G08B 29/00* (2006.01)
*G06M 7/00* (2006.01)

(52) U.S. Cl. ..... 250/221; 340/516

(58) Field of Classification Search ..... 250/221; 340/516, 545.1, 545.3
See application file for complete search history.

(56) References Cited

U.S. PATENT DOCUMENTS

| | | | | |
|---|---|---|---|---|
| 5,828,302 | A * | 10/1998 | Tsutsumi et al. | 340/540 |
| 6,181,095 | B1 * | 1/2001 | Telmet | 318/480 |
| 7,061,001 | B2 * | 6/2006 | Chaudhary et al. | 250/559.45 |

FOREIGN PATENT DOCUMENTS

| | | | |
|---|---|---|---|
| DE | 10100137 | A1 | 8/2001 |
| DE | 102007028979 | A1 | 3/2008 |
| GB | 2361310 | A | 10/2001 |
| JP | 10-61320 | A | 3/1998 |
| JP | 2000-160936 | A | 6/2000 |
| JP | 2002-227525 | | 8/2002 |
| JP | 2004-100184 | | 4/2004 |
| JP | 2005-201710 | | 7/2005 |
| JP | 2006-083529 | | 3/2006 |
| JP | 2006-112048 | | 4/2006 |
| JP | 2006-171839 | | 6/2006 |

OTHER PUBLICATIONS

International Search Report for PCT/JP2007/068525 dated Oct. 16, 2007. Office Action issued in corresponding Japanese Patent Application No. JP2006-288817, 2 pages.
European Search Report and Written Opinion dated Jul. 7, 2011 issued in corresponding European Patent Application No. 07828342.1, 5 pages.
Office Action dated Jan. 30, 2012, issued in corresponding Japanese Patent Application No. JP2006-288817, 2 pages.

* cited by examiner

*Primary Examiner* — Thanh Luu
(74) *Attorney, Agent, or Firm* — Duane Morris LLP

(57) ABSTRACT

A light-emitter emits light into a door opening of an automatic door system. A light-receiver receives light from the light-emitter which has passed through the door opening and develops a light-reception indicative signal. A door controller causes the light-emitter to stop emitting light and, thereafter, start emitting light. An auxiliary sensor is judged to be operating in order when the light-receiver does not develop light-reception indicative signal in a state where the light-emitter is not emitting light, and, thereafter, develops a light-reception indicative signal when the light-emitter resumes emitting light; otherwise, the auxiliary sensor is judged to be out of order.

4 Claims, 7 Drawing Sheets

AUTOMATIC DOOR SYSTEM WITH SENSOR USED THEREIN

FIELD OF THE INVENTION

This invention relates to a sensor for an automatic door system and, more particularly, to such a sensor capable of detecting malfunction thereof. Also, this invention relates to an automatic door system with such sensor used therein.

BACKGROUND OF THE INVENTION

Some automatic door systems use optical sensors for controlling opening and closing operations of a door panel. An example of such automatic door systems is disclosed in Patent Literature 1. According to the technology of Patent Literature 1, detecting ranges for detecting the presence of a human or an object are set in outdoor and indoor sides of an door opening formed in a wall of a building. There are provided activating sensors for detecting the presence or absence of a human or an object in the detection ranges. An auxiliary sensor is disposed on jambs erected on both sides of the door opening. A light-emitter is disposed on one of the jambs, and a light-receiver is disposed on the other jamb. The light-emitter and the light-receiver are facing each other. The auxiliary sensor is employed for keeping the door panel open when the presence of a human or an object in the vicinity of the door opening is detected when the door is open. The detection is based on reception, by the light-receiver, of no light from the light-emitter because of the light from the light-emitter intercepted by the human or object.

Patent Literature 1: JP 2002-227525

SUMMARY OF THE INVENTION

The light-emitter or light-receiver of the above-described auxiliary sensor may malfunction. For example, if the light-emitter fails to emit light, no light is received by the light-receiver, which may result in erroneous judgment as if the light was intercepted by a human or an object, although no human or object has been detected. As a result, the door panel is kept open, which means that the closing ability of the automatic door system is degraded. When the light-receiver is not receiving light, it malfunctions to develop an output similar to an output developed when it receives light, the light-receiver makes an erroneous detection indicating that no human or object is being detected. As a result, the door panel is closed even when a human or an object is present near the door opening, which may cause the human or object to collide with the door panel. Such malfunctions may occur not only in an auxiliary sensor but also in an optical-type activating sensor.

An object of the present invention is to provide a sensor for an automatic door, which can detect its own malfunction. Another object of the invention is to provide an automatic door system with improved closing ability and safety.

A sensor for an automatic door system according to one aspect of the present invention includes light-emitting means and light-receiving means. The light-emitting means emits light onto a human or object passing area in the automatic door system. It is desirable to use infrared light emitting means, for example, as the light-emitting means. The light-receiving means develops a light-reception indicative signal in accordance with reception of light coming from the light-emitting means through the passing area. Any types of light-receiving means appropriate for receiving the light from the light-emitting means can be used. For example, when the light-receiving means develops no light-reception indicative signal when the light-emitting means emits light, it is judged that a human or an object has been detected, and, when the light-receiving means develops a light-reception indicative signal in response to the light from the light-emitting means, it is judged that a human or an object has not been detected. The light-emitting means and the light-receiving mean may be disposed to face each other across the passing area, for example. Alternatively, the light-emitting means and the light-receiving means may be disposed on the ceiling of the automatic door system so that the light emitted by the light-emitting means can be reflected by the floor surface, which forms a part of the passing area, and be incident on the light-receiving means when a human or an object is not in the passing area. In this alternative arrangement, too, the absence of the light-reception indicative signal may mean the detection of an object, whereas the presence of the light-reception indicative signal means the non-detection. The light-emitting means and the light-receiving means may be activating sensors for controlling the opening and closing of a door panel of the automatic door system. Alternatively, they may be used as an auxiliary sensor for judging whether a human or object is present in an area through which the door panel moves. Light-emission control means causes the light-emitting means to stop emitting light and, then, to resume emitting light. The judging means judges, in the absence of a human or object, that the sensor is operating normal, when the light-emitting means is in the state where it stops emitting light and, therefore, the light-receiving means is in such light-reception indicative signal state in which it does not receive the light and, then, the light-receiving means is placed in such light-reception indicative signal state where it receives the light from the light-emitting means with the light-emitting means placed in the state where it re-starts to emit light; otherwise the judging means judges that the sensor is malfunctioning.

Although the light-emitting means is not emitting light, if the light-receiving means is malfunctioning, it may be in the same light-reception indicative signal state as the state in which it normally receives light from the light-emitting means. Accordingly, it is known that, when the light-emitting means is not emitting light, if the light-receiving means is in the same light-reception indicative signal state as the one in which it is not receiving light, the light-receiving means does not have the above-described failure. One of failures of the light-emitting means is failure to emit light. The fact that the light-emitting means is not malfunctioning can be known by causing the light-emitting means to emit light, with the light-receiving means being free of failure as described above, and by knowing that the light-receiving means is in the same light-reception indicative signal state as the state in which the light-receiving means is normally receiving light. In other cases, or more specifically, if the light-receiving means is not in the same light-reception indicative signal state as the state in which the light-receiving means is normally receiving light even after the light-emitting means has started to emit light, the light-receiving means is malfunctioning, and if the light-receiving means, which is operating normal, is not in the same light-reception indicative signal state as the state in which the light-receiving means is normally receiving light even after the light-emitting means has started to emit light, the light-emitting means is malfunctioning. In this way, it can be known that either one of the light-emitting and light-receiving means is malfunctioning.

Controlling of the light-emitting means by the light-emission control means and judgment by the judging means may be done before the door panel of the automatic door system starts to close, or, in other words, when the door panel in the open state starts to close.

With this arrangement, it can be known beforehand that a human or an object would be sandwiched or urged by the door panel against an article when the door panel is closing because of malfunctioning of the automatic door system sensor. It is desirable that, when the sensor for the automatic door system is judged to be malfunctioning, the closing operation of the door panel be forbidden, or that the door panel be closed at a lower speed than in the normal operation.

The described automatic door system sensor may be an auxiliary sensor for an automatic door system. As described previously, an auxiliary sensor is a sensor for use in judging whether a human or an object is present in a moving area through which the door panel moves when the open door panel is closed. The passing area is within the door panel moving area. Activating sensors having detection areas used for controlling the opening and closing of the door panel are disposed inside and outside the moving area. The controlling of the light-emitting means by the light-emission control means and the judging by the judging means may be done when the auxiliary sensor is not detecting a human or an object, although the detecting state of the activating sensors changes in a time sequential fashion within a predetermined time period. In other words, the controlling of the light-emitting means by the light-emission control means and the judging by the judging means may be done when the auxiliary sensor is not detecting a human or an object, although the activating sensor detects a human or an object on the indoor side of the automatic door system and, thereafter, the human or object is detected by the activating sensor on the outdoor side of the automatic door system, for example. The same can be applied to the case in which the auxiliary sensor is not detecting a human or an object, although the activating sensor detects a human or an object on the outdoor side of the automatic door system and, thereafter, the human or object is detected by the activating sensor on the indoor side of the automatic door system.

The above-described judgment, involving the light-emitting means' stopping and re-starting emitting light, if done frequently, causes excessive current to flow frequently through the light-emitting means, which, in turn, shortens the life of the light-emitting means. To avoid it, only when the auxiliary sensor is not detect a human or an object while the activating sensor is detecting the human or the object, the above-described judgment, involving the light-emitting means' stopping and starting emitting light, is carried out, to thereby keep the life of the light-emitting means longer.

In an arrangement in which the described automatic door system sensor according to the described aspect is used as an auxiliary sensor together with the activating sensors as in the above-described case, if the auxiliary sensor is judged to be malfunctioning, the door panel may be closed at a lower speed than the normal closing speed when the activating sensors judge that the human or the object has passed through the passing area. On the other hand, if the activating sensors judge that the human or the object has not passed through the passing area, the door panel is kept open.

With this arrangement, even when the auxiliary sensor is malfunctioning, or out of order, the detection result provided by the activating sensors can be used to control the opening and closing of the door panel. At the same time, if it cannot be known whether a human or an object has passed or not, the door panel is kept open. Thus, without greatly degrading the safety of the system, the passage of humans and/or objects, together with the closing ability of the door system can be retained.

DETAILED DESCRIPTION

Figure 2:
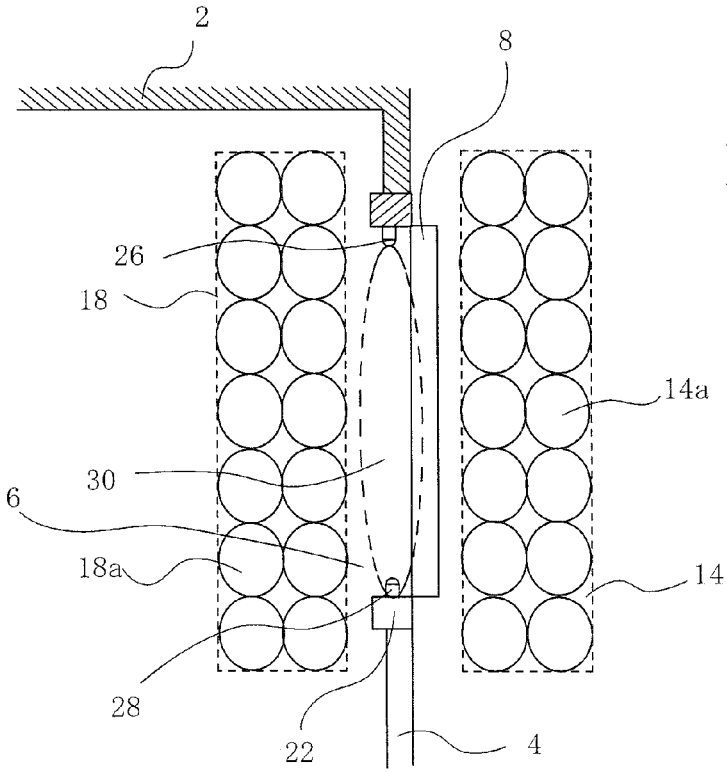
FIG. 2 is a plan view of the automatic door system shown in FIG. 1.

In an automatic door system using a sensor according to one embodiment of the invention, a door opening 6 is provided between a wall 2 separating the inside and outside of a building and a securing wall 4, as shown in FIG. 2. Humans can go into and out of the building through the door opening 6. A door panel 8 is adapted to slide in the width direction of the door opening 6 to open and close the door opening 6. Although a single sliding door with a single door panel is shown, a double sliding door with two door panels sliding in mutually opposite directions can be used, or a swing door panel can be used instead.

Figure 1:
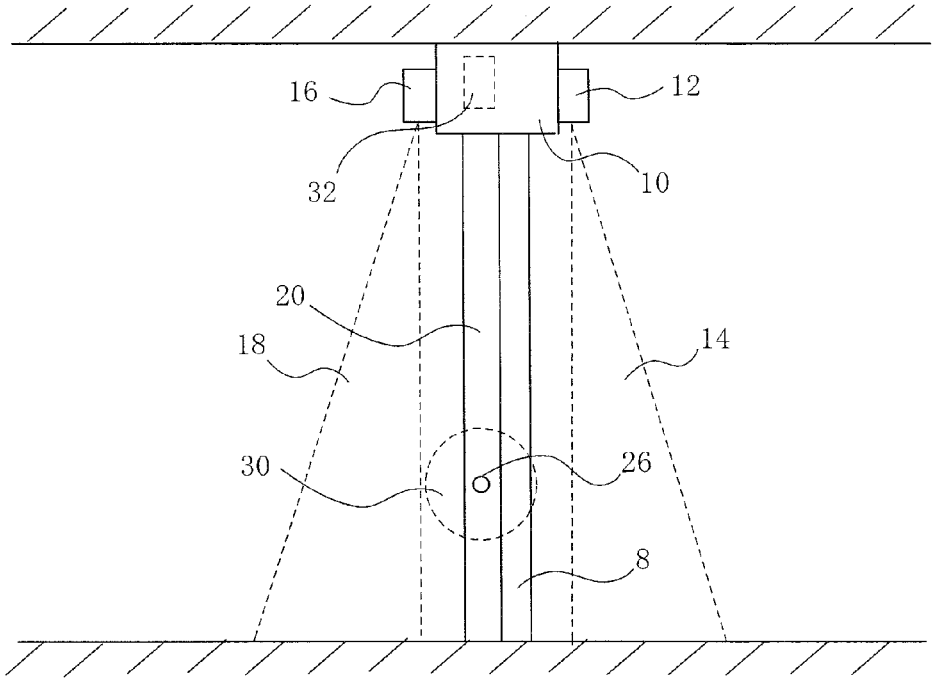
FIG. 1 is a side view showing a longitudinal cross-section of an automatic door system employing a sensor according to one embodiment of the present invention.

As shown in FIG. 1, an indoor-side activating sensor 12 is disposed on the indoor side of a lintel 10 in the upper side of the door opening 6. The indoor-side activating sensor 12 is of an optical type, and provides an indoor-side detecting area 14 extending from the indoor-side activating sensor 12 toward the indoor-side floor surface near the door opening 6. The indoor-side activating sensor 12 includes a plurality of light-emitters and a plurality of light-receivers corresponding to the respective light-emitters. As shown in FIG. 2, light, e.g. an infrared light ray, is projected to each small spot 14*a*, and the reflected light from each small spot 14*a* can be received by an associated light-receiver. Thus, when no human or object is present in the indoor-side detecting area 14, reflected light is received by the light-receivers, and if a human or an object is present in the indoor-side detecting area 14, reflected light is not received by the light-receivers. Whether or not a human or an object is present in the indoor-side detecting area 14 is determined based on whether or not the light-receivers receive light.

Similarly, an outdoor-side activating sensor 16 is disposed on the outdoor side of the lintel 10 as shown in FIG. 1, which provides, on the outdoor side, an outdoor-side detecting area 18 extending from the outdoor-side activating sensor 16 toward the outdoor-side floor surface near the door opening 6. The outdoor-side activating sensor 16, too, is arranged to project infrared light from its respective light-emitters onto a plurality of small spots 18*a* on the outdoor-side floor surface, with associated light-receivers arranged to be able to receive reflected light from the respective small spots 18*a*. Accordingly, as described above, whether or not a human or an object is present in the outdoor-side detecting area 18 is determined based on whether or not the light-receivers receive light.

Posts, e.g. jambs 20 and 22 are disposed on opposite sides of the door opening 6, facing each other across the door opening 6. Light-emitting means, e.g. light-emitter 26, of a photoelectric tube auxiliary sensor 24, is disposed on the jamb 20, and light-receiving means of the auxiliary sensor 24, e.g. light-receiver 28, is disposed on the jamb 22. The light-emitter 26 projects light, e.g. infrared light, to the light-receiver 28 through an auxiliary detecting area 30, all the time, as shown in FIG. 2. If no human or object is present in the auxiliary detecting area 30, the infrared light is received by the light-receiver 28, but, if a human or an object is present, the infrared light is intercepted by the human or object and, therefore, cannot be received by the light-receiver 28. In this way, whether or not a human or an object is present is determined depending on whether or not the light is received by light-receiver 28. It should be noted that, in FIG. 2, the sizes of the light-emitter 26 and the light-receiver 28 are exaggerated.

Control means, e.g. a door controller 32, controls the door panel 8 based on the detection results of the indoor-side and outdoor-side activating sensors 12 and 16 and the detection result of the auxiliary sensor 24. The door controller 32 is disposed within the lintel 10.

Figure 3:
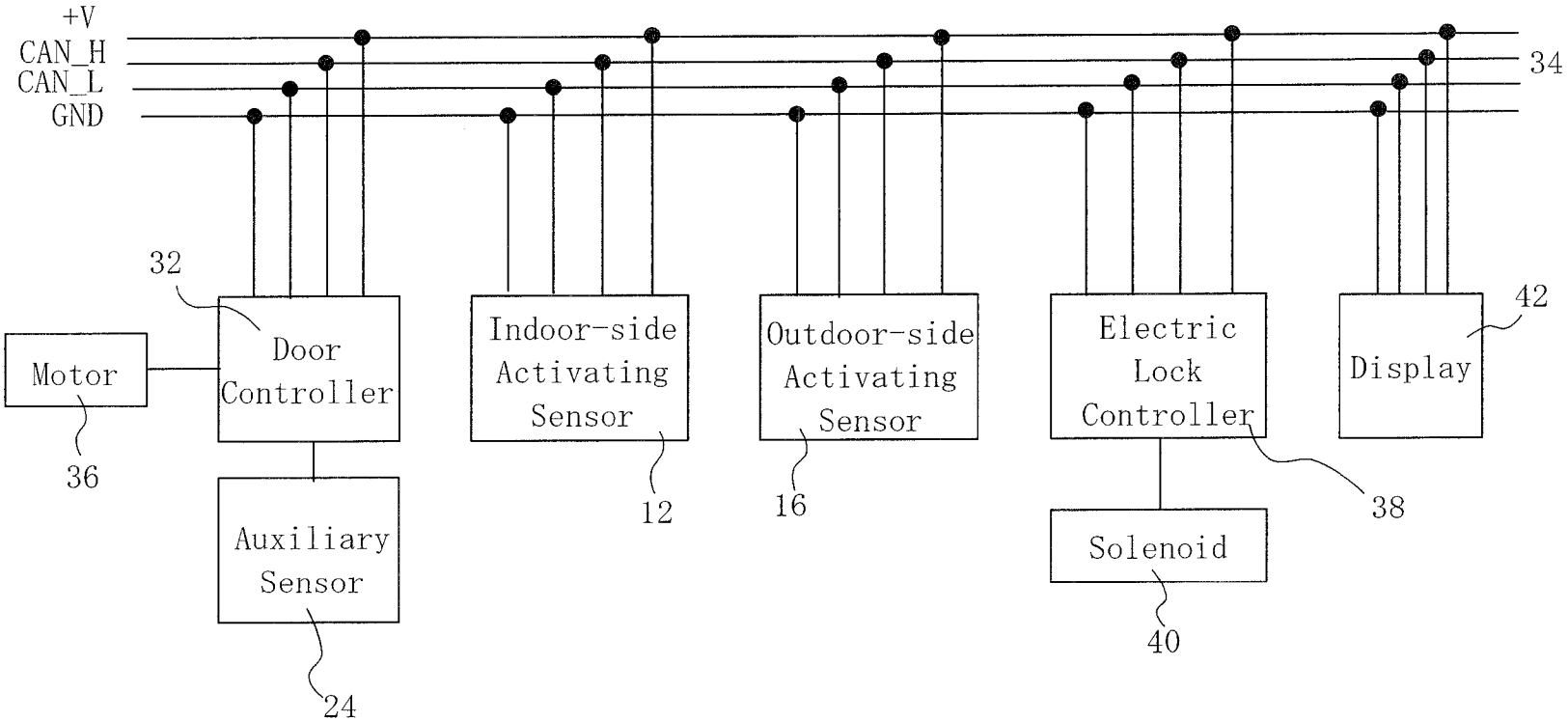
FIG. 3 is a block circuit diagram of the automatic door system shown in FIG. 1.

As shown in FIG. 3, the door controller 32 is connected to the indoor-side activating sensor 12 and the outdoor-side activating sensor 16, through a bus, e.g. a CAN (Controller Area Network) bus 34. The auxiliary sensor 24 is directly connected to the door controller 32. The door controller 32 controls driving means, e.g. a motor 36, to cause the door panel 8 to slide to thereby open the door opening 6 upon detection of a human or an object by the indoor-side activating sensor 12 or the outdoor-side activating sensor 16, when the door opening 6 is closed with the door panel 8. When a predetermined time lapses from the opening of the door opening 6, with the auxiliary sensor 24 detecting no human, and with the activating sensor different from the one which previously detected the human or object detecting no human or an object, the door controller 32 causes the door panel 8 to slide in the opposite direction to thereby close the door opening 6.

The door controller 32 is also connected to an electric lock controller 38 via the CAN bus 34. The electric lock controller 38 is to control an electric lock for locking the door panel 8 in an immovable state when the door panel 8 is in the state where the door opening 6 is closed by the door panel 8. Receiving a locking instruction from the door controller 32, the electric lock controller 38 energizes a solenoid 40, which drives the electric lock, to thereby cause the electric lock to lock the door panel 8. A display device 42 is also connected to the CAN bus 34, on which the operating states of the door controller 32, the indoor-side activating sensor 12, the outdoor-side activating sensor 16 and the electric lock controller 38 are displayed, and also through which operating parameters of these components are set.

When the light-receiver 28 of the auxiliary sensor 24 is in the normal operating state, the light-receiver 28 does not receive light if the light-emitter 26 becomes out of order so that it does not project light. As a result, although no human or object is present in the auxiliary detecting area 30, the auxiliary sensor 24 makes an erroneous determination as if a human or object were present. In such case, although a human or object has passed through the door opening 6, the door opening 6 is kept open, so that the closing ability of the automatic door system is lost. Also, when the light-emitter 26 is operating in order, if the light-receiver 28 is out of order and, when a human or object is present in the auxiliary detecting area 30, develops a light-reception indicative signal same as the one developed when the light-receiver is receiving light, meaning that the auxiliary sensor 24 makes an erroneous determination as if no human or object were present, the door panel 8 is driven to close so that it may or may not collide with the human or object. To avoid it, in the automatic door system according to the embodiment, the door controller 32 examines whether or not the auxiliary sensor 24 is malfunctioning, in the following manner.

Figure 4:
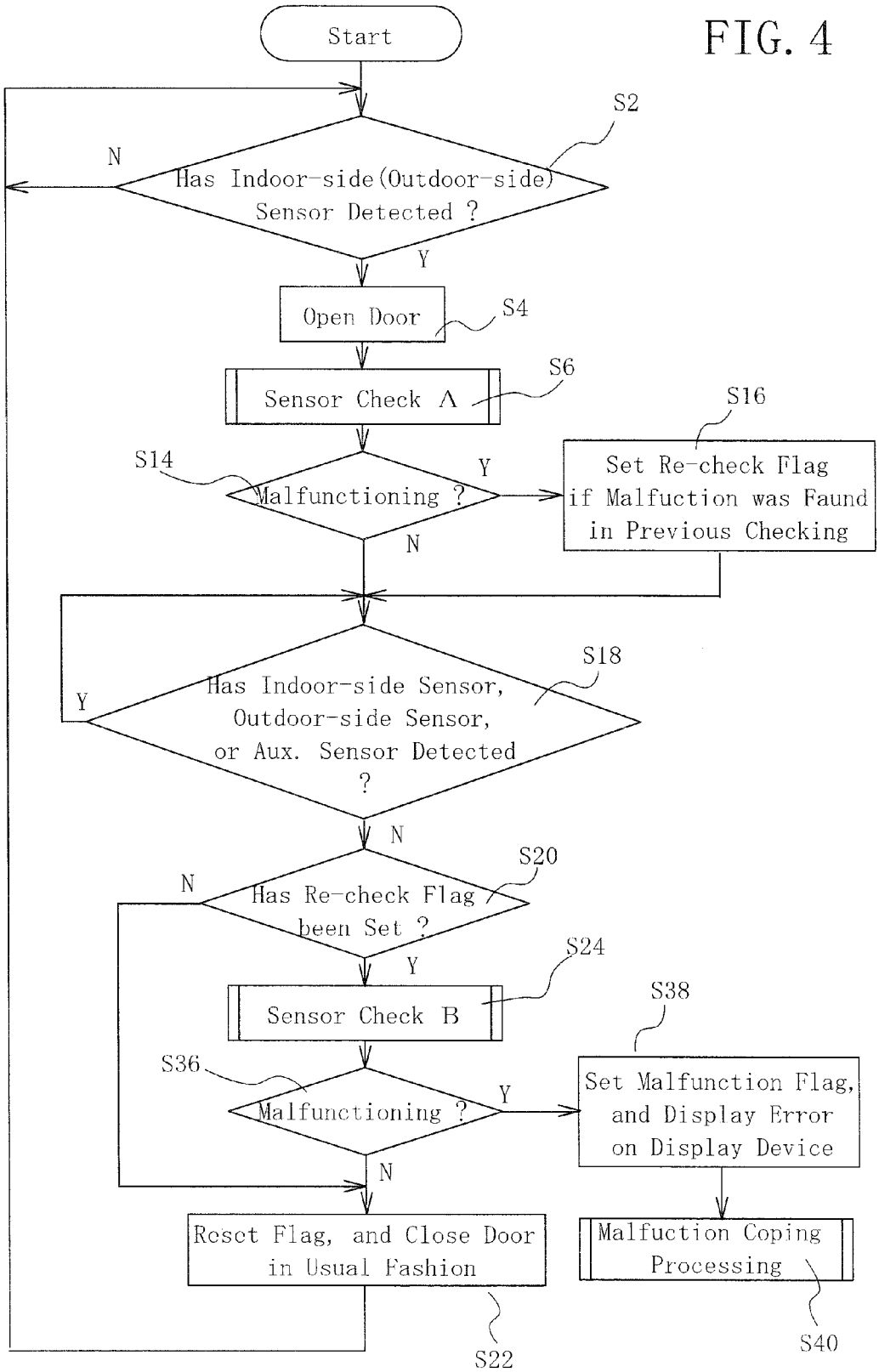
FIG. 4 is a main flow chart of the processing executed by a door controller of the automatic door system shown in FIG. 1.

First, as shown in FIG. 4, whether or not the indoor-side activating sensor 12 or the outdoor-side activating sensor 16 is detecting a human or an object is judged (Step S2). If the answer to this query is NO, Step S2 is repeated until the answer changes to YES. When the answer to the query made in Step S2 becomes YES, the opening operation to open the door panel 8 is carried out (Step S4). Subsequent to it, the sensor check A is carried out (Step S6).

Figure 5:
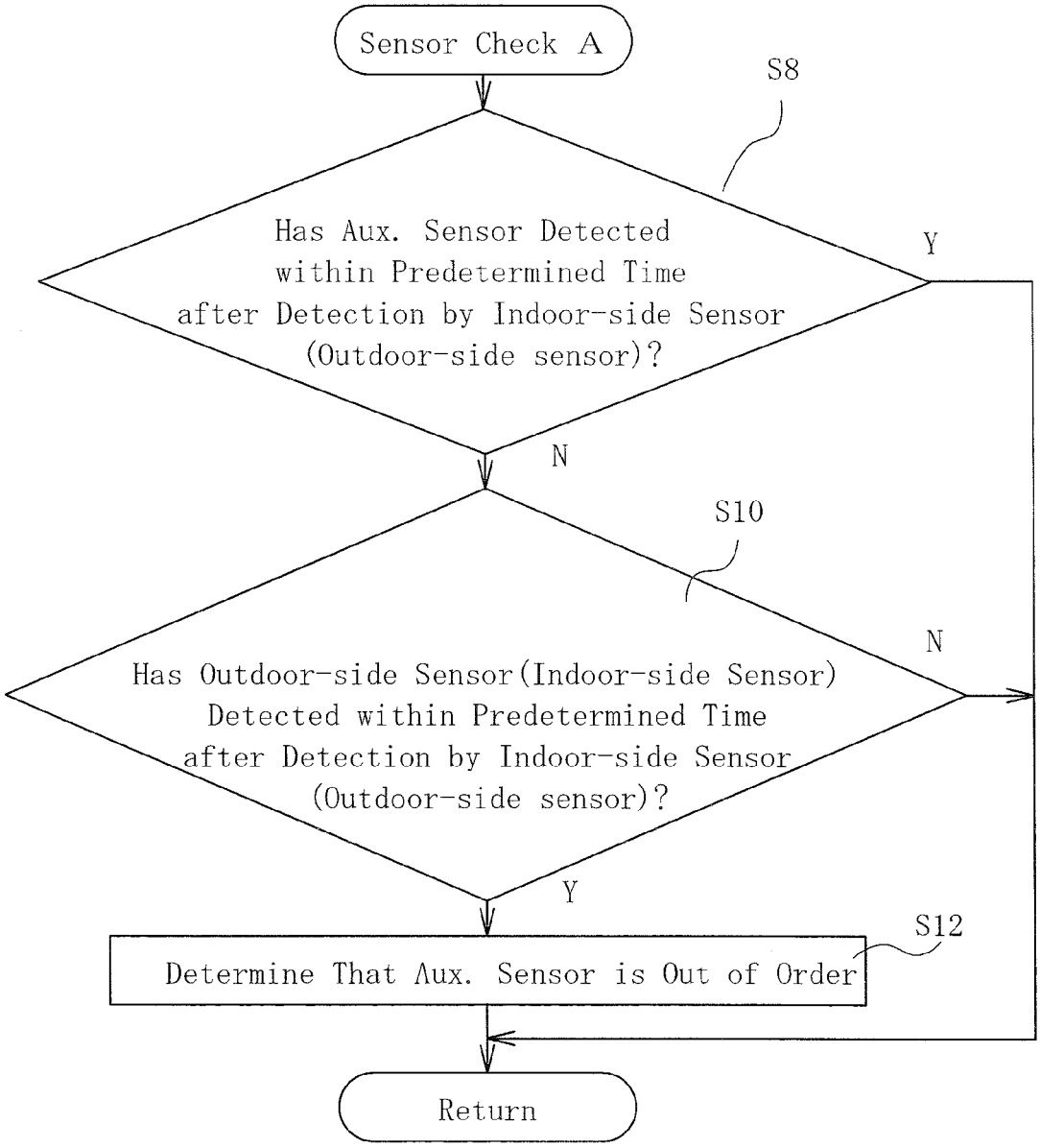
FIG. 5 is a flow chart of a sensor check A in the main flow chart shown in FIG. 4.
Figure 6:
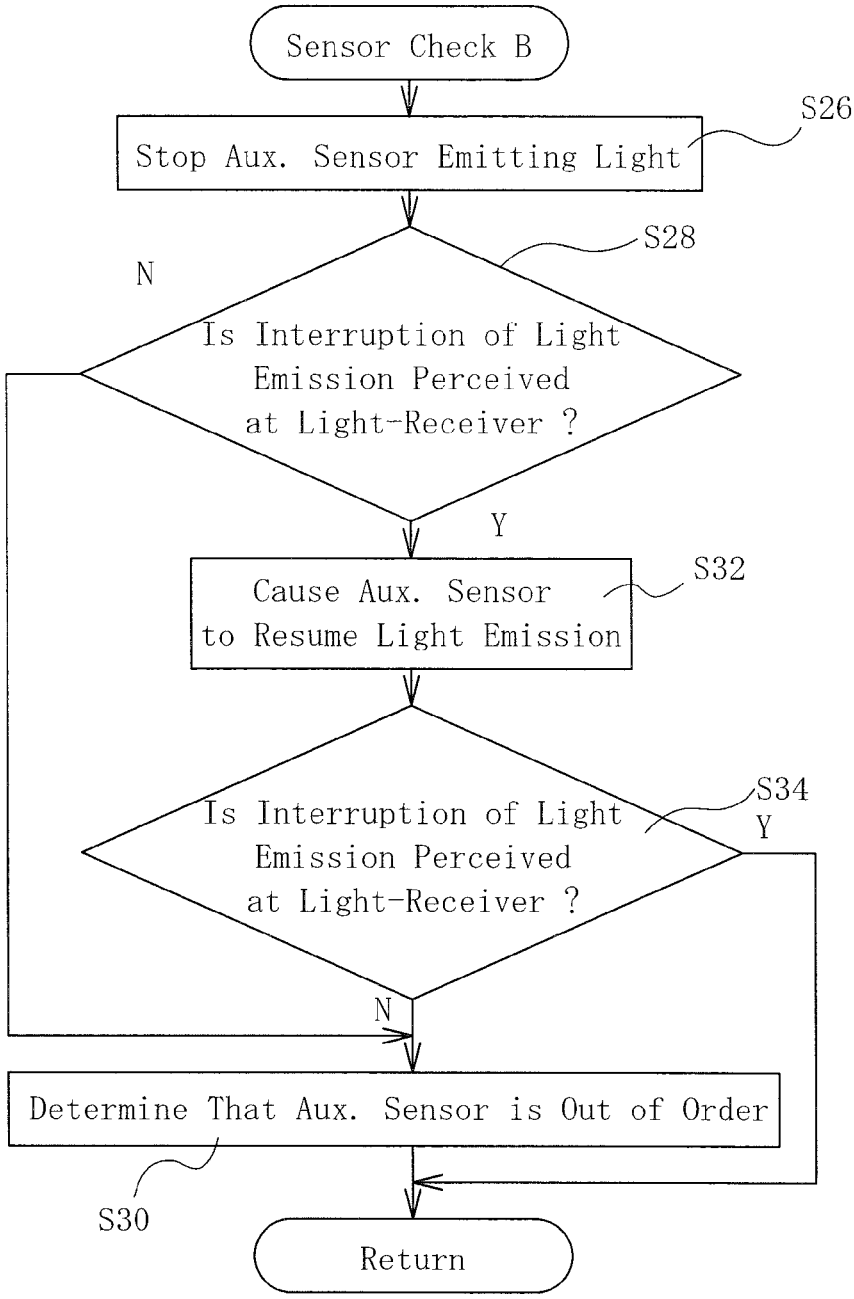
FIG. 6 is a flow chart of a sensor check B in the main flow chart shown in FIG. 4.

As shown in FIG. 5, in the sensor check A, it is determined whether or not the auxiliary sensor 24 detects a human or an object within a first set time after the detection in Step S2 of the human or object by the indoor-side activating sensor 12 or after the detection in Step S2 of the human or object by the outdoor-side activating sensor 16 (Step S8). (The first set time is, for example, the time required for a human or an object to pass through the indoor-side detecting area 14 and arrive at the auxiliary detecting area 30, or the time required for a human or an object to pass through the outdoor-side detecting area 18 and arrive at the auxiliary detecting area 30.) If the answer to this query is YES, the auxiliary sensor 24 can be thought to be in order, the processing of the sensor check A is finished.

If the answer to the query made in Step S8 is NO, while, in Step S2, it has been determined that the indoor-side activating sensor 12 has detected a human or an object, it is determined whether or not the outdoor-side activating sensor 16 has detected the human or object within a second set time starting from the detection of the human or object by the indoor-side activating sensor 12, or, if Step S2 has determined that the outdoor-side activating sensor 16 has detected a human or an object, determination is made as to whether or not the indoor-side activating sensor 12 has detected the human or object within the second set time starting from the detection of the human or object by the outdoor-side activating sensor 16 (Step S10). The second set time is, for example, the time required for a human or an object to go from the indoor-side detecting area 14 through the auxiliary detecting area 30 and arrive the outdoor-side detecting area 18, and also is the time required for a human or an object to go from the outdoor-side detecting area 18 through the auxiliary detecting area 30 and arrive the indoor-side detecting area 14.

If the answer to the query in Step S10 is NO, it can be judged that the human or object remains in the indoor-side detecting area 14 or in the outdoor-side detecting area 18, that the human or object has not yet passed through the auxiliary detecting area 30, and that the auxiliary sensor 24 is not out of order. Therefore, the processing of the sensor check A is finished.

The answer YES to the query made in Step S10 may mean, for example, that, although a human or an object was detected in the indoor-side detecting area 14 and, thereafter, the human or object is detected in the outdoor-side detecting area 18, the auxiliary sensor 24 has not detected the human or object, or that, although a human or an object was detected in the outdoor-side detecting area 18 and, thereafter, the human or object is detected in the indoor-side detecting area 14, the auxiliary sensor 24 has not detected the human or object. In other words, it means that, although the detection by the indoor-side activating sensor 12 and the outdoor-side activating sensor 16 changes time-sequentially, the auxiliary sensor 24 detects no human or object. Then, it is determined that the auxiliary sensor 24 is not in order (Step S12), and the sensor check A is finished.

Subsequent to the processing of the sensor check A, whether or not malfunctioning has been found in the sensor check A is determined (Step S14), as shown in FIG. 4. If the answer to the query is YES and malfunctioning was found in the previous door opening and closing operation, too, a flag for instructing to re-check the auxiliary sensor is set (Step S16). In Step S16, if it was determined that malfunctioning was not found in the previous door operation, the current malfunctioning is stored for the processing of Step S16 in the next time.

In case that the answer to the query made in Step S14 is NO, or subsequent to Step S16, it is determined whether or not the indoor-side activating sensor 12, the outdoor-side activating sensor 16, or the auxiliary sensor 24 is detecting a human or an object (Step S18). If the answer to the query is YES, Step S18 is repeated. When the answer to the query becomes NO, meaning that none of the indoor-side activating sensor 12, the outdoor-side activating sensor 16 and the auxiliary sensor 24 detects a human or object, it can be concluded that the human or object has gone from the indoor-side detecting area 14, passed through the auxiliary detecting area 30 and gone out through the outdoor-side detecting area 18, or, conversely, the human or object has gone from the outdoor-side detecting area 18, passed through the auxiliary detecting area 30 and gone out through the outdoor-side detecting area 14.

In such case, the operation to close the door panel 8 is carried out, but, before it, whether the re-check flag has been set or not is determined (Step S20). If the answer is NO, it can be judged that the auxiliary sensor 24 need not be re-checked, and, therefore, the flag is reset and the door panel 8 is closed as usual (Step S22). Subsequent to Step S22, Step S2 is executed again.

If the answer to the query made in Step S20 is YES, or, in other words, if malfunctioning has been determined consecutively twice in the sensor check A, a sensor check B is executed (Step S24).

In the sensor check B, light-emission from the light-emitter 26 is stopped (Step S26). Next, it is judged if the stopping of light-emission can be perceived by the light-receiver 28 (Step S28). Step S28 is executed by determining if the light-receiver 28 is developing a signal which the light-receiver 28 would generate when it receives the light from the light-emitter 26. If the answer is NO, it can be concluded that the light-emitter 28 is in the light-receiving state same as the one in which it receives light although it receives no light, and, therefore, the light-receiver 28 is judged to be out of order. Then, it is judged that the auxiliary sensor is malfunctioning (Step S30).

If the answer to the query made in Step S28 is YES, it can be judged that the light-receiver 28 is operating in order. Then, the light-emitter 26 is caused to start emitting light (Step S32). Whether or not a signal in response to the light-emission from the light-emitter 26 is developed by the light-receiver 28 is judged. In other words, whether the light-receiver 28 perceives the resumption of the emission of light is judged (Step S34). If the answer to the query made in Step S34 is YES, the light-emitter 26 can be judged to be operating in order, too. Then the sensor check B is finished. If the answer to the query made in Step S34 is NO, it can be judged that the light-emitter 26 is not emitting light and, therefore, is out of order. Then, Step S30 is executed, and a judgment that the auxiliary sensor 24 is out of order, is made. Then, the sensor check B is finished.

Subsequent to the sensor check B in Step S24, it is judged if the sensor check B has found malfunctioning, as shown in FIG. 4 (Step S36). If the answer to the query made in Step S36 is NO, or, in other words, if the auxiliary sensor 24 is judged to be operating in order, Step S22 is executed, the re-check flag is reset, and the usual door closing operation is done. After that, the processing is re-started from Step S2. On the other hand, if the answer to the query made in Step S36 is YES, or, in other words, if the auxiliary sensor 24 is judged to be malfunctioning, a malfunction flag is set and an error is indicated on the display device 42 (Step S38). Following it, malfunction coping processing is executed (Step S40). Based on the error indication, the auxiliary sensor 24 is repaired. The malfunction coping processing is executed in order to take care of the door system until the repair is made.

Figure 7:
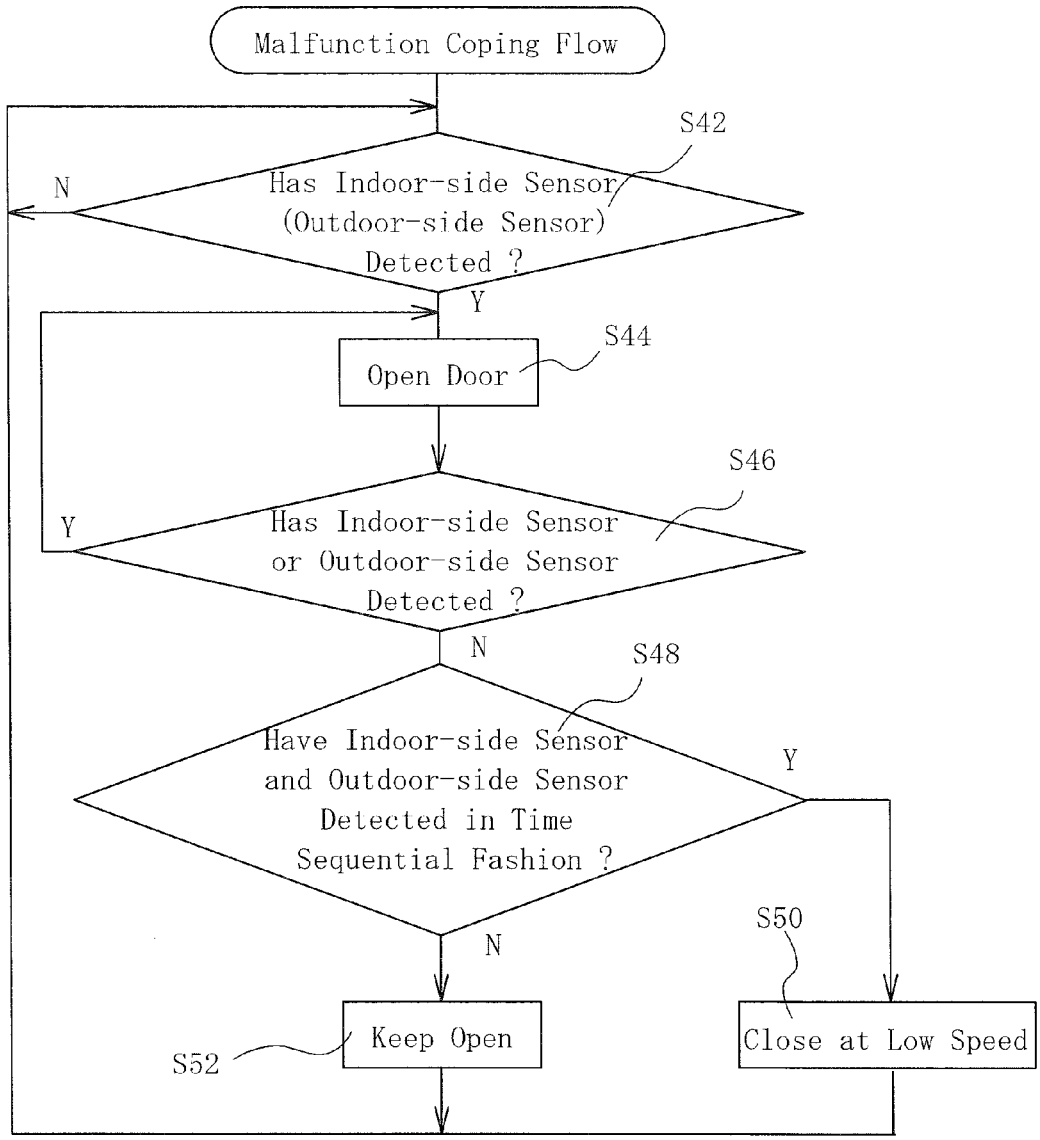
FIG. 7 is a flow chart of the processing for coping with malfunction in the main flow chart shown in FIG. 4.

As shown in FIG. 7, in the malfunction coping processing, first, it is determined whether the indoor-side activating sensor 12 or the outdoor-side activating sensor 16 is detecting a human or an object (Step S42). In other words, it is determined if a human or object is present in the indoor-side detecting area 14 or in the outdoor-side detecting area 18. If the answer to the query made in Step S42 is NO, Step S42 is repeated. If the answer is YES, the door opening operation takes place (Step S44).

Next, it is judged if either of the indoor-side activating sensor 12 and the outdoor-side activating sensor 16 detects the human or object (Step S46). If the answer to this query is YES, the processing is repeated from Step S44. When the answer to the query made in Step S46 becomes NO, or, in other words, if the human or object is detected neither in the indoor-side detecting area 16 nor in the outdoor-side detecting area 18, it is determined if the indoor-side activating sensor 12 and the outdoor-side activating sensor 16 have detected the human or object in a time-sequential manner (Step S48). Specifically, it is determined if a human or an object is initially detected by the indoor-side activating sensor 12, and, a predetermined time after that, the outdoor-side activating sensor 16 detects the human or object or, conversely, if a human or an object is initially detected by the outdoor-side activating sensor 16, and, the predetermined time after that, the indoor-side activating sensor 12 detects the human or object.

If the answer to the query is YES, it can be concluded that the human or object has moved from the indoor-side detecting area 14 through the door opening 6 to the outdoor-side detecting area 18, or, conversely, the human or object has moved from the outdoor-side detecting area 18 through the door opening 6 to the indoor-side detecting area 14. Then, the door panel 8 is closed at a lower speed. That is, the door panel 8 is closed at a speed lower than the usual closing speed (Step S50). The door panel 8 is closed at a lower speed in order to secure safety of the human or object, since the auxiliary sensor 24 is malfunctioning and, therefore, cannot detect a human or object, if any, in the vicinity of the door opening 6.

The answer NO to the query made in Step S48 may mean that the human or object was in the indoor-side detecting area 14, for example, but it did not proceed to the door opening 6, but proceeded away from the door opening 6 in the opposite direction, or that the human or object was in the outdoor-side detecting area 18, but it did not proceed to the door opening 6, but proceeded away from the door opening 6 in the opposite direction. Then, the door panel 8 is kept open (Step S52). The door panel 8 is kept open for the purpose of securing the safety of the human or object, since it cannot be determined whether the human or object has passed. After the execution of Step S50 or S52, the processing is executed again from Step S42. Thus, once the auxiliary sensor 24 is judged to be out of order, the auxiliary sensor 24 does not take part in door opening and closing control, but the door opening and closing control is done using the activating sensors 12 and 16.

Figure 8:
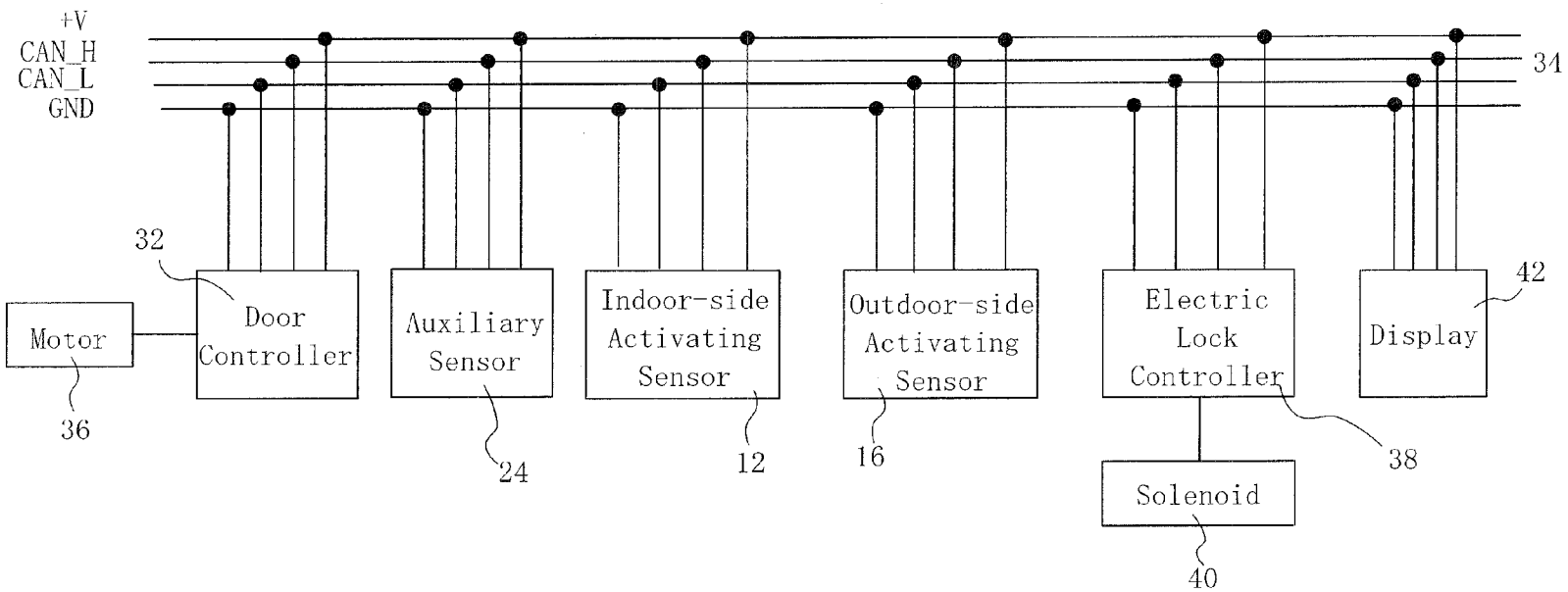
FIG. 8 is a block circuit diagram of a modification of the automatic door system shown in FIG. 1.

In the described embodiment, the auxiliary sensor 24 is connected directly to the door controller 32, but the auxiliary sensor 24, too, can be connected to the CAN bus 34, as shown in FIG. 8, so that the auxiliary sensor 24 can transmit the detection result to the door controller 32 through the CAN bus 34.

In the described embodiment, the sensor check A is carried out to find the malfunction of the auxiliary sensor 24 before making a closer examination through the sensor check B as to whether the auxiliary sensor 24 is out of order or not. This arrangement is employed for the following reason. In the sensor check B, the light-emitter 26 is caused to stop and resume emitting light, and, each time the emission is stopped and resumed, large current flows through the light-emitter 26. Therefore the life of the light-emitter 26 would be shortened if the sensor check B is performed each time the door panel 8 is closed. Therefore, the sensor check A, which does not involve making the light-emitter 26 to stop and resume emitting light, is performed first, and, only when it is considered that the auxiliary sensor 24 may be out of order, close checking is performed through the sensor check B, to thereby prevent the life of the auxiliary sensor 24 from being shortened. Thus, if the life of the auxiliary sensor 24 is not a significant matter, Steps S6, S14, S16 and S22 can be eliminated, and the auxiliary sensor 24 can be checked through the sensor check B.

The sensor check B is executed after Step S20, and, as a result, whether the auxiliary sensor 24 is in order or not is checked before the door panel 8 is closed. Checking the auxiliary sensor 24 immediately before the door panel 8 is closed is for reducing the possibility of human's being sandwiched between the door panel and the jam or anything else. It should be noted, however, the auxiliary sensor 24 need not be checked before the closing operation, but it may be checked, for example, just after the power supply is connected to the automatic door system. Alternatively, the sensor check B may be performed when the opening and closing operation of the door panel 8 is not done for a predetermined time after the last opening and closing operation.

In the described embodiment, the sensor check B is performed when the malfunctioning is determined two consecutive times in the sensor check A. This is because, if a human or an object stays in the indoor-side detecting area 14, for example, for a time longer than the second set time, the auxiliary sensor 24, even if it is operating in order, is judged to be out of order. However, the auxiliary sensor 24 may not be out of order even when it is judged to be out of order in one sensor check A. It may be arranged that the sensor check B is performed when the malfunctioning is determined a predetermined number of times more than two.

In the described embodiment, the malfunction coping processing is executed in Step S40 when the auxiliary sensor 24 is judged to be out of order. This is for securing the closing ability, which is one of the advantages of the automatic door system, after a human or an object has passed through the door opening 6, while taking the safety into account, in spite of the malfunctioning of the auxiliary sensor 24. However, if it is desired to ensure the safety at the sacrifice of the closing property, the door opening 6 may be kept open after the execution of Step S38.

In the described embodiment, the activating sensors 12 and 16 are of optical type, but they may be any ones of various known activating sensors, such as ones of ultrasonic type or ones of distance measurement type. Also, the auxiliary sensor 24 is not limited to one of photoelectric tube type, but it may be an infrared reflective type, like the activating sensor 12, disposed beneath the lintel.

What is claimed is:

1. An automatic door system, comprising:

a door panel for opening and closing a door opening;

door opening means for causing said door panel to open said door opening;

an automatic door system sensor for said automatic door system including light-emitting means emitting light onto a passing area associated with said door opening, and including light-receiving means developing a light-reception indicative signal when said light-receiving means receives light from said light-emitting means that has passed said passing area;

determining means for determining whether a human or object is present in said passing area on the basis of the light-reception indicative signal from said automatic door system sensor and causing said door opening means to cause said door panel to open said door opening;

first light-emission control means for controlling said light-emitting means to change the state of said light-emitting means from a light-emitting state in which said light-emitting means emits light, to a light-emission stop state in which said light-emitting means stops emitting light, while said door opening is opened with said door panel moved to open said door opening by said door opening means according to the determination made by said determining means;

first judging means for judging whether said light-receiving means develops said light-reception indicative signal when said first light-emission control means changes the state of said light-emitting means from said light-emitting state to said light-emission stop state, and, if said first judging means judges that said light-receiving means is developing said light-reception indicative signal, judging that said sensor is out of order;

second light-emission control means for changing the state of said light-emitting means from said light-emission stop state to said light-emitting state when said first judging means judges that said light-reception indicative signal is not being developed;

second judging means for judging whether said light-receiving means develops said light-reception indicative signal when said second light-emission control means places said light-emitting means in said light-emitting state, said second judging means judging that said sensor is in order if said second judging means judges that said light-reception signal is being developed and judging that said sensor is out of order if said second judging means judges that said light-reception indicative is not being developed; and door closing means for causing said door panel to close said door opening when said second judging means judges that said sensor is in order.

2. An automatic door system according to claim 1, wherein:

said automatic door system sensor is an auxiliary sensor for said automatic door system;

said passing area is within a moving area through which said door panel moves;

said automatic door system further comprises activating sensors having detecting areas disposed inward and outward of said moving area, respectively;

said door opening means causes said door panel to open said door opening when at least one of said activating sensors detects an object, and said door closing means causes said door panel to close said door opening when said second judging means judges that said auxiliary sensor is in order with said door opening kept open and with said at least one activating sensor not detecting an object.

3. An automatic door system according to claim 1, wherein:

said automatic door sensor is an auxiliary sensor for said automatic door system;

said passing area is within a moving area through which said door panel moves;

said automatic door system further comprises:

activating sensors having detecting areas disposed inward and outward of said moving area, respectively; and means for causing said first and second light-emission control means to control said light-emitting means and causing said first and second judging means to make judgment, when said auxiliary sensor does not detect a human or an object although the detection by at least one of said activating sensors changes in a time sequential fashion within a predetermined time period.

4. An automatic door system according to claim 1, wherein:

said automatic door sensor is an auxiliary sensor for said automatic door system;

said passing area is within a moving area through which said door panel moves;

said automatic door system further comprises:

activating sensors having detecting areas disposed inward and outward of said moving area, respectively; and means for making, when said auxiliary sensor is judged to be out of order, said door closing means to cause said door panel to close said door opening at a speed lower than a normal speed when at least one of said activating sensors determines that an object has passed said passing area, and making said door opening kept open when said at least one activating sensor determines that an object has not passed said passing area.

* * * * *